United States Patent [19]

von Stein

[11] Patent Number: 4,691,647

[45] Date of Patent: Sep. 8, 1987

[54] OPTICAL THREAD BREAKAGE MONITORING APPARATUS

[75] Inventor: Walter von Stein, Waldkirch, Fed. Rep. of Germany

[73] Assignee: Erwin Sick GmbH Optik Elektronik, Waldkirch, Fed. Rep. of Germany

[21] Appl. No.: 924,377

[22] Filed: Oct. 29, 1986

[30] Foreign Application Priority Data

Nov. 7, 1985 [DE] Fed. Rep. of Germany ..... 3539536

[51] Int. Cl.[4] ..... D05C 15/08; D05C 15/18

[52] U.S. Cl. ..... 112/80.18; 112/273; 250/561; 200/61.18

[58] Field of Search ..... 112/80.18, 271, 273, 112/278; 200/61.13, 61.18; 250/561, 571; 66/163

[56] References Cited

U.S. PATENT DOCUMENTS

| | | | |
|---|---|---|---|
| 4,109,594 | 8/1978 | Spanel et al. | 112/80.18 X |
| 4,538,536 | 9/1985 | Sick | 172/80.18 X |
| 4,549,413 | 10/1985 | Flamig | 250/561 X |
| 4,625,666 | 12/1986 | Sick | 112/80.18 X |

*Primary Examiner*—Ronald Feldbaum
*Attorney, Agent, or Firm*—Townsend & Townsend

[57] ABSTRACT

An optical thread breakage monitoring apparatus for tufting machines has a laser beam scanning apparatus (21). The retroreflecting strip (11) illuminated by this laser beam scanning apparatus (21) is secured above the eyes (12) of the needles (13) to the front side of the needle beam (14) (FIG. 1).

10 Claims, 2 Drawing Figures

OPTICAL THREAD BREAKAGE MONITORING APPARATUS

Figure 1:
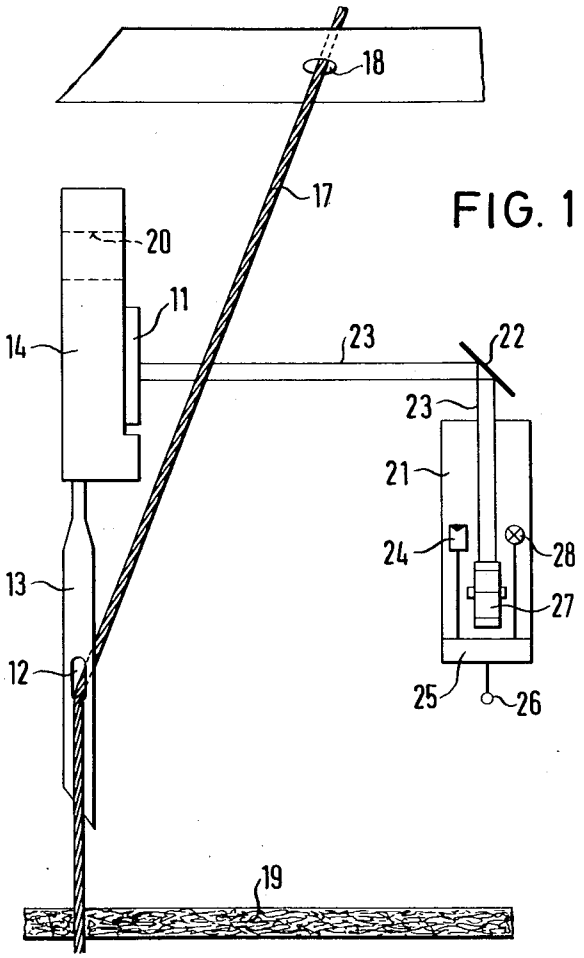

The invention relates to an optical thread breakage monitoring apparatus for tufting machines comprising a laser beam scanning device which generates a laser beam which executes a continually repeating rapid scanning movement perpendicular to the needles of the needle row and which, when it impinges onto a retroreflecting strip arranged behind the threads being worked by the needles, as a result of a thread breakage or as a result of passing through the thread gaps, onto a retroreflecting strip arranged behind the threads being worked by the needles, is reflected back on itself and is incident in the laser beam scanning device on a photoreceiver connected to an electronic processing circuit which, in the event of a change of the normally present periodic signal generates a fault signal.

In such known optical thread breakage monitoring apparatus (DE-OS No. 33 31 772; DE-PS No. 34 47 869) the retroreflecting strip is mounted on a special reflector rail which lies at the tufting machine on the carrier material to be worked directly behind the needle row.

The reflector rail reflects the incident scanning laser light beam back to the scanning device between the tufting threads through the gap between the needle bars which are the highest point of their stroke and the tensioned threads of the carrier material. This arrangement has the disadvantage, that the reflector rail hinders the view into the machine directly at the needles and indeed over a length of up to 40 mm in the transport direction of the carrier material. The reflector rail also hinders the threading in of broken threads and the guiding through of sewn on carrier material which arises on changing the roll of carrier material. The splice or seam formed in this way can be up to four times as thick as the carrier material itself. The seam can easily be drawn beneath the needle tips over the entire width of ca. 5 m, through the 3 to 5 mm large gap between the carrier material and the needles at the highest point of the needle stroke, however the fixed reflector rail hinders the pulling forward of the web of carrier material. The through-gap beneath the reflector rail is so narrow that the reflector rail must either be lifted on guiding through the splice which however brings about the danger of disadjustment. In some cases the reflector rail must indeed be dismantled. Moreover, the gap between the needle tips with the needle beam in the upper position and the carrier material, which is all that can be used for the measurement, is so small that only a very small retroreflecting strip and a short scanning light bead of for example 2 mm can be used, which brings about adjustment problems.

The object of the invention is thus to provide an optical thread breakage monitoring apparatus of the initially named kind in which the retroreflecting strip is so arranged that it neither hinders the view into the machine nor its operation in any manner, with the fault recognition being further improved, to the extent that any thread faults which occur can be recognized before the thread is worked into the carrier material, and in which the adjustment of the laser beam on the retroreflecting strip is unproblematic.

In order to solve this problem the invention provides that the retroreflecting strip is secured above the eyes of the needles to the front side of the needle beam.

In this manner a special reflector rail can be avoided because an element which is in any event present for carrying the needles can also be used for the placement of the retroreflecting strip. The retroreflecting strip is preferably arranged in the lower half of the needle beam. The retroreflecting strip can also be of substantially broader construction, for example 10 to 15 mm wide, so that the adjustment of the laser beam relative to the retorreflector is simplified substantially.

As each retroreflecting strip is expediently only between 10 and 20 cm long the total retroreflecting strip is expediently put together from a plurality of retroreflectors which are arranged in series and which overlap one another. In this arrangement the ends of the retroreflecting strips should be cut off obliquely to the needle direction in the overlapping region. The angles of the end edges of the retroreflecting strips to the needle direction should amount to at least 20° to 30° and to at most 45°. In this manner disturbances of the received signal due to the overlapping regions of the adjoining retroreflecting strips are avoided.

The retroreflecting strips are advantageously used with a thickness of only approximately 0.5 mm.

Thus, in accordance with the invention, a continuous and gapless total reflecting band is present on the needle beam over the entire tufting width of up to 5 m above the eyes of the needles. The filaments which are tensioned in front of the reflecting strip shade off the laser beam whereas the gap between the tensioned threads free the passage of the laser beam to the retroreflecting strip. The reflected light is deflected back through an autocollimation beam path into the laser beam scanning device and is incident there on a photoreceiver, which passes a signal to the electronic processing circuit, which evaluates the received signal in the desired manner for fault recognition.

Whereas, in the known arrangements of the retroreflecting strip at a special reflector rail the faults recognized by the laser beam scanning device are already present in the finished tufted material, the arrangement of the retroreflecting strip in accordance with the invention makes it possible for the fault to be indicated before it is noticable in the finished tufted goods. The fault can thus be recognized before it impairs the finished tufted goods and can be rectified.

The needle stroke out of the carrier material amounts to between 3 and 8 mm, can however also amount to only 2 to 3 mm for tufted looped goods and very rapidly running tufting machines. This signifies that the laser scanning light bead which is only 0.2 mm wide and approximately 2 mm high has to be very precisely adjusted over the entire monitoring width of 5 m in the known thread breakage monitoring apparatus. In view of the small space that is available the reflector strip on the reflector rail could only have a height of approximately 3 to 4 mm.

However, on the needle beam ca. 10 to 15 mm is available in the vertical direction for the attachment of the retroreflecting strip, so that a precise adjustment of this kind is no longer necessary if the operation takes place in accordance with the invention.

A further advantageous embodiment of the invention is characterized in that, with a width of the laser scanning light bead of ca. 0.2 mm, the height of the scanning light bead amounts to 3 to 7 mm, in particular to 4 to 6 mm and preferably to approximately 5 mm. As a result of this measure it is also possible to detect very fine yarns. The extension of the laser scanning light beam in the vertical direction is possible without problem because of the larger width of the retroreflecting strip arranged in accordance with the invention.

For tufted looped goods the problem exists of recognising a so-caller puller or also spanner. As with a ladder in a stocking the thread is again drawn out of the already tufted goods due to the thread being held in the eye of the needle, for example by a knot in the thread.

If, as previously, the retroreflecting strip is secured to the hold-down bar of the tufting machine then a fault of this kind cannot be recognised because, despite the fault, the tensioned threads extend will continue to extend in front of the retroreflector and will be recognised by the laser beam as being present.

However, as a result of the knot in the eye of the needle the thread coming from above will be blocked and thus positions itself irregularly in front of the retroreflecting strip arranged in accordance with the invention above the eye of the needle. Thus troublefree and rapid fault recognition is also possible in this case.

Figure 2:
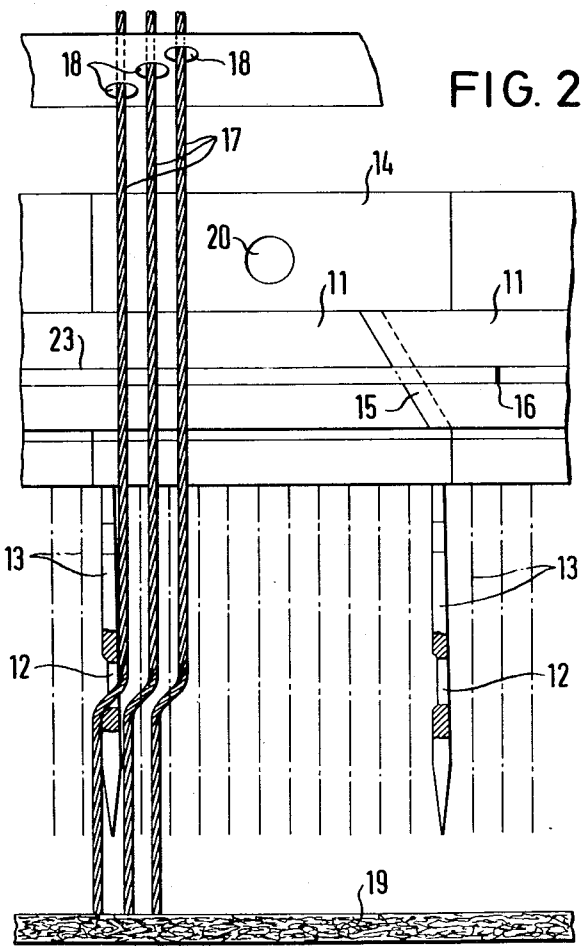

The invention will now be described by way of example only in the following and with reference to the drawing which shows:

FIG. 1 a schematic sideview of a tufting machine in the region of the needle row, with the laser scanning apparatus being schematically indicated, and FIG. 2 a front view of the subject of FIG. 1, however with only a small part of the width of the needle row of the tufting machine being shown.

In the drawing the needle beam 14 which carries the needles 13 of the tufting machine is shown in the uppermost position of the needle stroke, so that the course of the threads 17 can be better illustrated. The threads 17 are guided through bores 18 above the needle beam 14 and in front of the latter in the manner evident from FIGS. 1 and 2 obliquely downwardly to the eyes 12 of the needles 13 from where they extend into the carrier material 19 of the tufted goods. During further operation of the tufting machine the needle beam 14 is moved downwardly whereby the needles 13 with the threads 17 which they guide penetrate through the carrier material. During this the position of the threads 17 in front of the needle beam 14 does not change substantially.

Reference numeral 20 indicates one of the bores by means of which the needle beams are secured to suitable stroke members within the tufting machine. As seen in FIG. 1 a laser beam scanning device 21 generates, as is for example described in DE-OS No. 33 31 772, a vertically extending scanning light beam which executes a rapid scanning movement perpendicular to the plane of the drawing of FIG. 1. In general several such laser beam scanning devices 21 are arranged alongside one another over the width of the tufting machine. The laser beam 23 is deflected via a deflecting mirror 22 into the horizontal direction and directed onto the needle beam 14, the lower half of which is occupied by a retroreflecting strip 11. A laser beam scanning device as described in DE-PS No. 34 47 869 us preferably used.

The retroreflecting strip 11 reflects, in so far as it is hid by the laser beam 23, the light back on itself and allows it to pass inside the laser beam scanning device onto a schematically illustrated photoreceiver 24 which is connected to an electronic processing circuit 25 which transmits the fault signal at the output 26. The scanning movement of the laser beam is caused by a schematically illustrated mirror wheel 27 which is illuminated, in non-illustrated manner by the laser 28.

As can be seen from FIGS. 1 and 2 the laser beam 23 strikes the relatively wide retroreflecting strip 11 approximately at a mid-height region so that the retroreflecting strip 11 is still reliably hit even if some maladjustment of the laser beam is present and no disturbances arise due to the laser light beam 23 striking beneath the retroreflecting strip 11.

The entire retroreflecting strip 11 consists of individual part strips of 10 to 20 cm length. These part strips are obliquely cut in accordance with FIG. 2 at the ends and are arranged so that they overlap so that there is no interruption of the retroreflecting surface at this position.

As seen in FIG. 2 the laser beam scanning light bead 16 is of elongate shape in the vertical direction. Its vertical extent amounts to approximately 5 mm, whereas its width has a value of approximately 0.2 mm. In conjunction with the inclined position of the abutment line between adjacent retroreflecting strips 11 the elongate construction of the scanning light bead 16 ensures that no fault signal occurs as it runs over the abutment positions.

For a tufting machine operating in troublefree manner a periodic signal is generated in the electronic processing circuit 25 because the laser scanning light bead 16 is alternately interrupted by the threads and reflected back from the regions of the retroreflecting strip 11 between two threads 17. If a thread is missing, or if some other change of the correct thread position occurs, then the periodic signal normally detected by the electronic processing circuit 25 changes and a fault signal is generated which appears at the output 26.

In the drawing the needle beam 14 is shown for impoved clarity, as being struck in the upper position by the laser beam 23 at the center. In actual fact however, the laser beam 23 is arranged lower by the stroke of the needle beam 14, i.e. only adopts the position shown in the drawing relative to the retroreflecting strip 11 when the needle beam 14 is located at its lowest position. The threads 17 are then namely best tensioned.

I claim:

1. Optical thread breakage monitoring apparatus for tufting machines comprising a laser beam scanning device which generates a laser beam which executes a continually repeating rapid scanning movement perpendicular to the needles of the needle row and which, when it impinges onto a retroreflecting strip arranged behind the threads being worked by the needles,, as a result of a thread breakage or as a result of passing through the thread gaps, is reflected back on itself and is incident in the laser beam scanning device on a photoreceiver connected to an electronic processing circuit which, in the event of a change of the normally present periodic signal generates a fault signal, characterised in that the retroreflecting strip (11) is secured above the eyes (12) of the needles (13) to the front side of the needle beam (14).

2. Optical thread breakage monitoring apparatus in accordance with claim 1, characterised in that the retroreflecting strip (11) is arranged in the lower half of the needle beam (14).

3. Optical thread breakage monitoring apparatus in accordance with claim 1, characterised in that the retroreflecting strip (11) is 10 to 15 mm wide.

4. Optical thread breakage monitoring apparatus in accordance with claim 1, characterised in that the retroreflecting strip (11) is put together from a plurality of retroreflecting strips (11) which are arranged in series and overlap one another.

5. Optical thread breakage monitoring apparatus in accordance with claim 4, characterised in that the ends of the retroreflecting strips which follow one another are cut off obliquely to the needle direction in the overlapping region (15).

6. Optical thread breakage monitoring apparatus in accordance with claim 5, characterised in that the angles of the end edges of the adjoining retroreflecting strips (11) amount to at least 20° to 30° and to at most 45° relative to the needle direction.

7. Optical thread breakage monitoring apparatus in accordance with claim 1, characterised in that the laser scanning light bead (16) that is used is elongate in the thread direction.

8. Optical thread breakage monitoring apparatus in accordance with claim 7, characterised in that the width of the laser scanning light beam (16) amounts to ca. 0.2 mm.

9. Optical thread breakage monitoring apparatus in accordance with claim 7, characterised in that the height of the laser scanning light bead (16) amounts to 3 to 7 mm, in particular to 4 to 6 mm and preferably to approximately 5 mm.

10. Optical thread breakage monitoring apparatus in accordance with claim 1, characterised in that the laser beam (23) is arranged at a level such that it impinges at the middle of the retroreflecting strips (11) when the needle beam (14) is in its lowest position; and in that the electronic processing circuit (25) only initiates a measurement in this position.

* * * * *